United States Patent [19]

Bowler

[11] 4,200,063

[45] Apr. 29, 1980

[54] ENGINE FUEL INJECTION CONTROL APPARATUS WITH SIMULTANEOUS PULSE WIDTH AND FREQUENCY ADJUSTMENT

[75] Inventor: Lauren L. Bowler, Bloomfield Hills, Mich.

[73] Assignee: General Motors Corporation, Detroit, Mich.

[21] Appl. No.: 888,244

[22] Filed: Mar. 20, 1978

[51] Int. Cl.[2] ..... F02B 3/00

[52] U.S. Cl. ..... 123/32 EF; 123/32 EA; 123/32 EE

[58] Field of Search ..... 123/32 EA, 32 EE, 32 EF, 123/119 EC, 32 EC; 60/276, 285

[56] References Cited

U.S. PATENT DOCUMENTS

| | | | |
|---|---|---|---|
| 3,665,899 | 5/1972 | Nagy | 123/32 EF |
| 3,665,901 | 5/1972 | Monpedet et al. | 123/32 EF |
| 3,682,144 | 8/1972 | Sudu | 123/32 EF |
| 3,768,449 | 10/1973 | Lindberg | 123/32 EF |
| 3,780,711 | 12/1973 | Lindberg | 123/32 EC |
| 3,908,616 | 9/1975 | Sasayama | 123/32 EC |
| 3,927,304 | 12/1975 | Wentworth et al. | 123/32 EC |
| 4,002,152 | 1/1977 | Hoshi | 123/32 EA |
| 4,020,802 | 5/1977 | Hattori et al. | 123/32 EA |
| 4,056,932 | 11/1977 | Nakumura et al. | 60/276 |
| 4,069,795 | 1/1978 | Long et al. | 123/32 EA |
| 4,073,270 | 2/1978 | Endo | 123/32 EF |
| 4,084,552 | 4/1978 | Drews et al. | 123/32 EA |

FOREIGN PATENT DOCUMENTS

| | | | |
|---|---|---|---|
| 2261432 | 6/1973 | Fed. Rep. of Germany | 123/32 EF |
| 1440346 | 6/1976 | United Kingdom | 123/32 EF |

*Primary Examiner*—Charles J. Myhre
*Assistant Examiner*—R. A. Nelli
*Attorney, Agent, or Firm*—Robert M. Sigler

[57] ABSTRACT

In a fuel injected vehicle engine having pulse generating apparatus for controlling the activation of a fuel injector for the duration of fuel injection pulses according to the fuel requirements of the engine, apparatus responsive to the normal duration of the pulses is effective, when the normal pulses are shorter than a predetermined minimum desired pulse duration, to increase simultaneously both the intervals between the pulses and the durations of the pulses by a common factor N from the normal interval and durations, to increase fuel flow accuracy at low fuel supply rates.

2 Claims, 3 Drawing Figures

ENGINE FUEL INJECTION CONTROL APPARATUS WITH SIMULTANEOUS PULSE WIDTH AND FREQUENCY ADJUSTMENT

BACKGROUND OF THE INVENTION

This invention relates to engine fuel injection systems, and particularly to those of the type in which a fuel injector having an open condition and a closed condition controls the flow of fuel from a constant pressure source.

In such a fuel injection system, apparatus is provided to generate fuel injection pulses at a predetermined frequency or repetition rate and having durations determined according to one or more environmental and/or engine operating parameters. The apparatus is further effective to apply the fuel injection pulses to the fuel injector to activate it to its open position for the duration of the pulses and to close it between said pulses. Since the flow of fuel through the injector is essentially constant while it is in its open position, the durations of said pulses determine the fuel flow rate to the engine.

However, at the beginning and end of each of the fuel injection pulses, while the injector is opening and closing, the fuel flow through the injector is not constant; and this introduces some inaccuracy between the desired fuel flow rate as embodied in the fuel injection pulses and the resulting fuel flow rate through the injector. When the fuel injection pulses are relatively long in duration, this inaccurary is small as a fraction of the total fuel flow rate and is essentially negligible. However, at low engine speeds and loads, when the fuel flow rate is small and the fuel injection pulses thus must be comparatively short, the inaccuracy is a greater fraction of total fuel flow. It therefore may be desirable, for some engines, to define a minimum injection pulse width, below which an undesirable degree of inaccuracy is introduced into the fuel flow rate. For a particular engine, if such a minimum desired fuel injection pulse width exists and if the corresponding fuel flow is greater than a fuel flow rate expected in the normal course of operating such an engine, such as at idle, it is desirable to provide some means to eliminate this inaccuracy or at least minimize its effect on engine operation.

SUMMARY OF THE INVENTION

This invention provides apparatus for eliminating or minimizing the inaccuracy associated with fuel injection pulses of duration shorter than a predetermined minimum desired fuel injection pulse time duration by detecting the first such short fuel injection pulse and increasing, simultaneously, the pulse duration and interval between pulses, by a common factor N, for succeeding fuel injection pulses until the normal pulse duration once again increases beyond the predetermined desired minimum pulse duration. In its preferred embodiment, the invention includes apparatus for measuring the normal fuel injection pulse time duration and comparing it to a reference minimum desired duration, although alternative embodiments could measure the parameters used to determine fuel injection pulse duration and compare them with reference values corresponding to such a minimum desired duration. The preferred embodiment further includes apparatus responsive to the detection of a short duration pulse to alter the clock or timing means of the pulse generating apparatus to lengthen both the duration of the pulses and the interval between the pulses simultaneously by the same factor N so that total fuel flow is essentially unchanged but is more accurately controlled, due to the longer pulse durations. When the normal pulse duration increases once again past the reference minimum desired duration, the apparatus reverts to its normal state and the normal pulses are supplied.

Further details and advantages of this invention will be apparent from the accompanying drawings and the following description of a preferred embodiment.

DESCRIPTION OF THE PREFERRED EMBODIMENT

Figure 1:
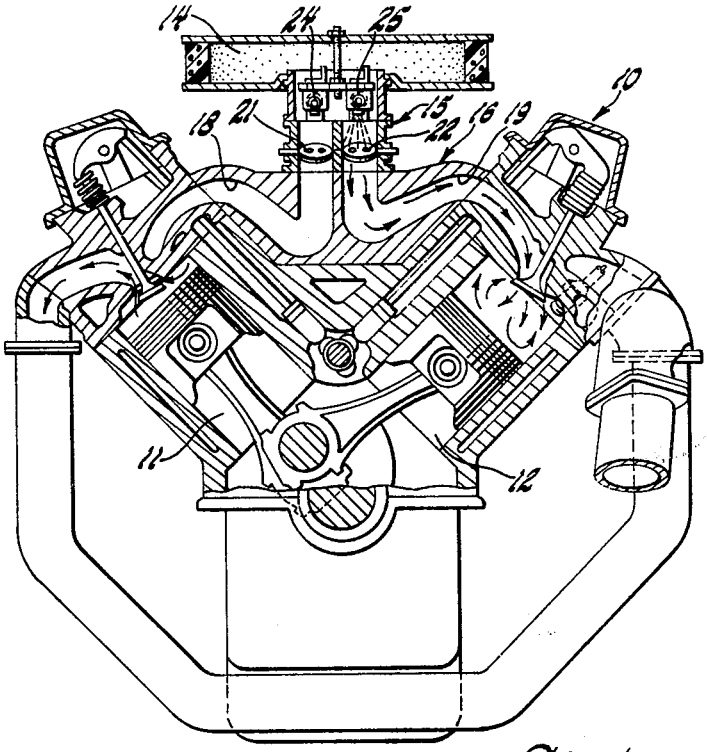
FIG. 1 shows a vehicle engine having fuel injection apparatus according to this invention.

FIG. 1 shows an internal combustion engine 10 adapted for use in a motor vehicle. Engine 10 is a multicylinder engine with the cylinders arranged in a V configuration with a left bank 11 and a right bank 12. Air induction means are provided for engine 10 in the form of an air cleaner 14, a throttle body 15 and an intake manifold 16 comprising intake passages 18 and 19 to left bank cylinders 11 and right bank cylinders 12, respectively. The flow of air through the above-described air induction means into the cylinders 11 and 12 is controlled by a pair of throttle plates 21 and 22 within throttle body 15.

The fuel induction system for engine 10 comprises means, not shown, for supplying liquid fuel at a constant pressure to a pair of fuel injectors 24 and 25 in throttle body 15. The fuel supply means can comprise the standard elements of a fuel injection system: a fuel tank, fuel pump, pressure regulator and appropriate conduits interconnecting the elements.

Fuel injectors 24 and 25 may be of any of the well known type which are normally closed until electromagnetically actuated to open and allow fuel flow therethrough, in their open condition, at a constant rate, assuming a constant fuel supply pressure. Fuel injectors 24 and 25 are directed to spray atomized fuel toward intake passages 18 and 19, respectively, whereby injector 24 supplies fuel to the left bank cylinders 11 and injector 25 supplies fuel to the right bank cylinders 12. Injectors 24 and 25 may be fired simultaneously or alternately; but they act as a single injector in the sense that each cylinder of engine 10 receives fuel from only one of the injectors. It should be noted that this is only a preferred embodiment among many possible for this invention. Another embodiment, for instance, could include a single injector or a pair of injectors operated simultaneously into a single mixing plenum or chamber in intake manifold 16. A further example might provide an individual injector for each cylinder adjacent the intake port in intake manifold 16. The particular form of the fuel injection system and intake manifold, as well as the specific number of injectors, are not significant to this invention except for the fact that each cylinder receives fuel from a single injector.

Figure 2:
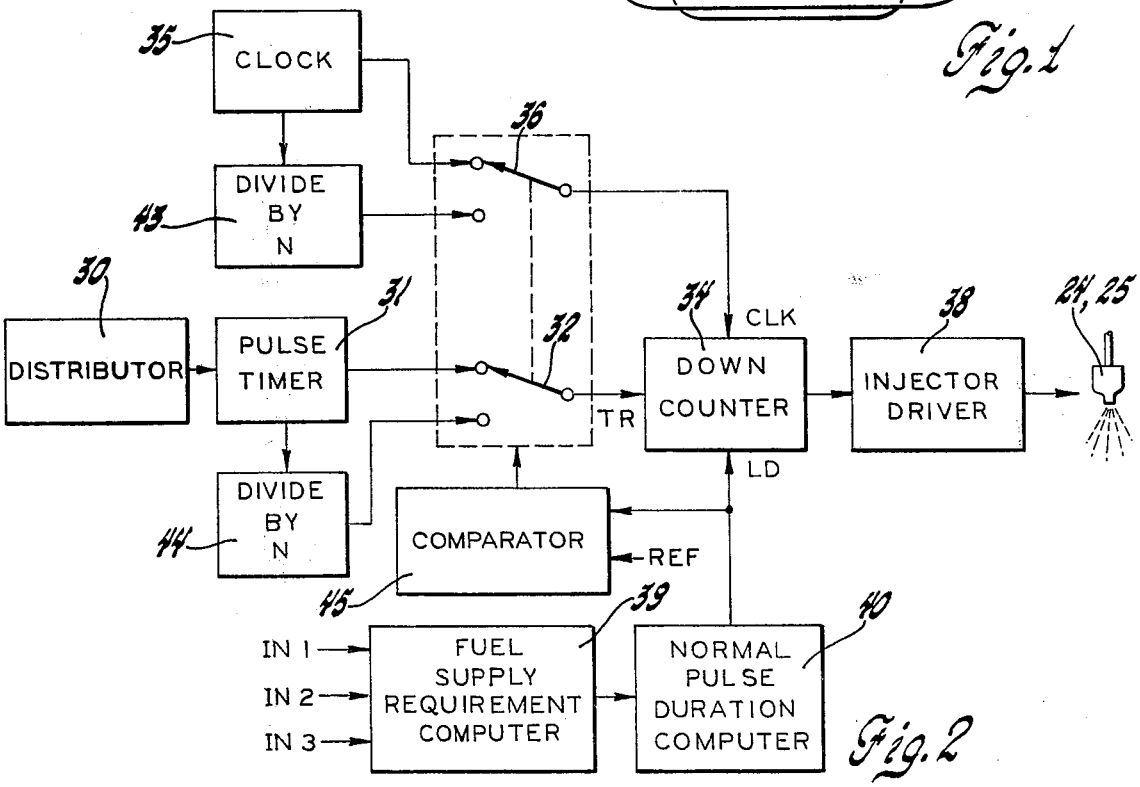
FIG. 2 shows a block diagram of control apparatus according to this invention for use in the fuel injection system shown in FIG. 1.

Referring to FIG. 2, the fuel injector control apparatus is shown in block diagram form. The blocks of FIG. 2 may represent discrete items as named and described, joined as shown in a hard-wired arrangement; but they may also represent portions of a programmed digital computer which includes a stored program that converts the digital computer into the equivalent of the apparatus shown in FIG. 2. Given the description of this specification, the programming of such a computer would be obvious to a trained programmer who used the block diagram of FIG. 2 as the basis for a flow chart.

Distributor 30 of FIG. 2 is the standard distributor, not shown, of engine 10 of the type shown in the U.S. patent to Falgy U.S. Pat. No. 3,254,247. Such a distributor generates pulses at a rate proportional to engine speed, which pulses are provided to a pulse timer 31. Pulse timer 31 is responsive to the pulses from distributor 30 to generate injector timing pulses, which occur at the same rate as the pulses from distributor 30 but which may be delayed therefrom by a predetermined time or crankshaft angle. These injection timing pulses from pulse timer 31 may be selected, in this embodiment by a switch 32, for application to the trigger or TR input of a down counter 34.

A clock 35 provides clock pulses at a fast rate which may be selected, in this embodiment, by a switch 36 for application to the clock or CLK input of down counter 34. Each time an injection timing pulse is received on its TR input, down counter 34 counts clock pulses downward from an initial fuel pulse number, entered on the load or LD input, to zero. While it is counting, down counter 34 generates an output to injector driver 38 to cause the activation of injectors 24 and 25 to their open state and thus cause the injection of fuel therefrom for a length of time determined by down counter 34.

A fuel supply requirement computer 39 receives one or more inputs IN1, IN2 and IN3, which may be engine operating parameters such as engine speed or manifold absolute pressure or environmental parameters such as atmospheric pressure or ambient temperature. Computer 39 is provided with a stored algorithm or lookup table by which it repetitively computes numbers representing a required fuel flow rate for engine 10. The numbers representing said repetitively provided fuel flow rates are supplied to normal pulse duration computer 40, which generates from them the fuel pulse numbers for application to the LD input of down counter 34, which numbers represent the number of clock pulses from clock 35 which would make up a normal pulse duration for a fuel injection pulse to meet the fuel flow rate requirement when applied to injectors 24 and 25. Thus, under conditions described so far, down counter 34 is effective to generate a normal fuel injection pulse the timing of which is determined by the injection timing pulse received at the TR input and the duration of which is determined by the fuel pulse number received at the LD input from normal pulse duration computer 40 and the clock rate of the clock pulses received at the CLK input from clock 35. The duration of such normal fuel injection pulses will vary with the fuel supply requirement as determined by computer 39 and will be greater for high fuel flow and narrower for low fuel flows.

It is well known, however, that in the type of fuel injector used as the fuel injectors 24 and 25, inaccuracy in fuel flow is introduced as a result of the transient operation of the injectors as they are opening and closing. This inaccuracy, when measured as a percentage of total fuel flow, naturally increases at low fuel flow rates, since the flow under transient conditions at such low fuel flow rates is a larger percentage of the total fuel flow as a result of the short fuel injection pulse duration. There may be, for engine 10, a minimum desired pulse duration which corresponds to the fuel flow rate which is not the minimum fuel flow rate required by engine 10. Therefore, a divide by N counter 43 is provided with an input from clock 35 and an output to switch 36 for application, alternatively to the output of clock 35, to the CLK input of down counter 34. A similar divide by N counter 44 is provided with an input from pulse timer 31 and an output to switch 32 to be applied, alternatively to the output of pulse timer 31, to the TR input of down counter 34. Switches 32 and 36 are caused to operate together so that clock 35 is always connected to down counter 34 together with pulse timer 31 and divide by N counter 43 is always connected to down counter 34 together with divide by N counter 44.

To control switches 32 and 36, a comparator 45, in this embodiment a digital comparator, is connected to receive the output of normal pulse duration computer 40 and compare it with a reference REF. Reference REF is equal to the output fuel pulse number of computer 40 which corresponds to the minimum desired pulse time duration; and comparator 45 is effective to switch switches 32 and 36 to the positions shown in FIG. 2, in which they provide normal clock and injection timing pulses to down counter 34, when the output of computer 40 equals or exceeds reference REF and is further effective to switch switches 32 and 36 to the alternative position, in which they provide the outputs of divide by N counters 43 and 44 to down counter 34, when the output of computer 40 is less than reference REF.

Since divide by N counter 43 provides clock pulses to down counter 34 at a slower rate than the clock pulses from clock 35 by a factor or multiple N, which in this embodiment may be 2, the duration of the fuel injection pulses from down counter 34 is effectively doubled. Thus the required pulse duration may be shortened further, up to a factor of 2, without entering the region of undesirable inaccuracy. However, since the injection timing pulses derived from divide by N counter 44 are separated in time by a period also increased by the same factor N, or 2 in this embodiment, the fuel injection pulses from down counter 34 occur at half the normal rate; and the fuel flow per unit time is correct as determined by computer 39.

Figure 3:
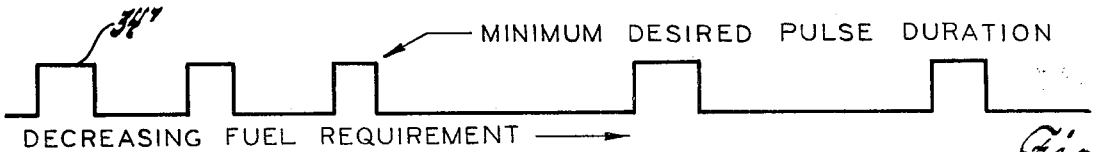
FIG. 3 shows a train of fuel injection pulses produced by the control apparatus of FIG. 2 under a decreasing fuel requirement.

FIG. 3 shows a series of pulses 34' on the output of down counter 34 in a period of decreasing fuel requirement as determined by computer 39 and communicated to down counter 34 by computer 40. The first three pulses from the left in FIG. 3 are at the normal clock rate and show steadily decreasing duration, with the third being labeled as the minimum desired pulse duration. The output from computer 40, however, causes comparator 45 to switch switches 32 and 36 and thus cause an increase in the period between the third, fourth and fifth pulses to double that between the first, second and third and a pulse duration for the fourth and fifth pulses which is double that of the corresponding normal pulses. Of course, in a time of increasing fuel requirement, the opposite would occur, as can be seen by following the pulse train from right to left.

The embodiment as shown and described in the specification uses synchronous injection, since the injection pulses are timed by pulses derived from the distributor and thus are synchronized with engine crankshaft rotation and the openings of individual cylinder intake valves. The invention, however, can also be used with asynchronous injection, in which the fuel injection pulses are not so timed. The only difference in the apparatus of FIG. 2 would be the replacement of distributor 30 as the source of timing pulses by an independent source of timing pulses not synchronized with the engine. In addition, it is contemplated that a non-integer factor N greater than one could be used with a slight change in the apparatus of FIG. 2. If each of the divide by N counters 43 and 44 were replaced by non-synchronous frequency conversion apparatus that would be effective to monitor the frequency of the timing or clock pulses and generate alternate timing or clock pulses at frequency smaller by a factor N not synchronized with the normal pulses, the factor N could assume non-integer values and could, with appropriate apparatus, be varied in operation. For instance, the apparatus could be designed so that, when the normal fuel injection pulse width reached the minimum desired pulse width, smaller fuel flows would be obtained by smoothly decreasing the frequency of pulses by increasing the factor N, without changing the pulse width.

Further embodiments of this invention will be apparent to those skilled in the art; and it should therefore be limited only by the claims which follow.

The embodiments of the invention in which an exclusive property or privilege is claimed are defined as follows:

1. In a fuel injected vehicle engine including means effective to generate fuel injection pulses at first predetermined times separated by first intervals, the pulses having first variable durations the magnitude of which are determined by control means in accordance with engine fuel flow requirements and said first intervals, the engine further including means responsive to said pulses to inject fuel into the engine for the duration of said pulses, the injecting means thereby providing fuel to the engine in accordance with the requirements thereof but with an accuracy tending to decrease with decreasing pulse duration, the improvement comprising:

means responsive to the first time duration of each of said fuel injection pulses as determined by said control means and effective, when said first pulse time duration is shorter than a predetermined minimum desired pulse duration, to generate and apply to the injecting means alternate fuel injection pulses having second intervals therebetween and second durations both increased by a common factor N from the first intervals and first durations, respectively, whereby the accuracy of the fuel injecting means is increased at low fuel supply rates.

2. In a fuel injected vehicle engine including means to inject fuel into the engine for the duration of fuel injection pulses with an accuracy tending to decrease with decreasing duration of said fuel injection pulses, apparatus for generating said fuel injection pulses comprising, in combination:

first means effective to generate first fuel injection timing pulses at predetermined times separated by first time intervals;

second means for generating first clock pulses at a first rate faster than that of the first fuel injection timing pulses;

third means responsive to one or more engine operating parameters to repetitively compute a required fuel flow rate and generate fuel pulse numbers representative thereof;

fourth means effective to compare said fuel pulse numbers to a reference indicative of a minimum desired fuel injection pulse duration and generate a first output when the numbers are less than said reference and a second output when the numbers are greater than said reference;

fifth means responsive to the first clock pulses to generate alternative clock pulses at a rate slower than the rate of said first clock pulses by a factor N;

sixth means responsive to the first means to generate alternative fuel injection timing pulses separated by intervals which are a multiple N of the first intervals;

seventh means effective to generate a fuel injection pulse beginning with each fuel injection timing pulse and having duration equal to a fuel pulse number of clock pulses;

eighth means responsive to the comparator to provide the first clock pulses and first fuel injection timing pulses to the seventh means while the comparator is in its first state and to provide the alternative clock pulses and alternative fuel injection timing pulses to the seventh means when the comparator is in its second state, whereby the fuel injection means can provide fuel accurately even when the first fuel injection pulse duration would be less than the minimum desired pulse duration.

* * * * *